US010064505B2

(12) United States Patent
Röhrig

(10) Patent No.: US 10,064,505 B2
(45) Date of Patent: Sep. 4, 2018

(54) DRINKING DEVICE WITH A CONVEYING MEANS

(71) Applicant: MAM BABYARTIKEL GESELLSCHAFT M.B.H., Vienna (AT)

(72) Inventor: Peter Röhrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 0 days.

(21) Appl. No.: 14/401,342

(22) PCT Filed: May 14, 2013

(86) PCT No.: PCT/AT2013/050108

§ 371 (c)(1),
(2) Date: Nov. 14, 2014

(87) PCT Pub. No.: WO2013/170286

PCT Pub. Date: Nov. 21, 2013

(65) Prior Publication Data

US 2015/0157151 A1 Jun. 11, 2015

(30) Foreign Application Priority Data

May 14, 2012 (AT) ..... A 50181/2012

(51) Int. Cl.
*A47G 19/22* (2006.01)
*A61G 9/00* (2006.01)
*A61G 11/00* (2006.01)

(52) U.S. Cl.
CPC ..... *A47G 19/2272* (2013.01)

(58) Field of Classification Search
CPC ..... A61J 9/00; A61J 11/002; A47G 19/2272
(Continued)

(56) References Cited

U.S. PATENT DOCUMENTS 2,263,947 A * 11/1941 Gottfried ..... 220/710
4,016,998 A 4/1977 Finch
(Continued)

FOREIGN PATENT DOCUMENTS

CN 102020051 A 4/2011
DE 10016053 A1 10/2001
(Continued)

OTHER PUBLICATIONS

International Preliminary Report on Patentability filing date May 14, 2013; PCT/AT2013/050108.
(Continued)

*Primary Examiner* — Andrew T Kirsch
(74) *Attorney, Agent, or Firm* — Ladas & Parry LLP

(57) ABSTRACT

Drinking device (1) with a closure cap (4) having a drinking opening (6) and intended for closing a drinking container (2) which has a receiving chamber (3) for liquid, and with a conveying means (7) for conveying liquid from the receiving chamber (3), wherein the conveying means (7) has an inner wall element (8) which is received in an outer wall element (9) so as to form a space, wherein the space defines between the wall elements (8,9) a conveying duct (11) which is connected via an inlet opening (12) to the receiving chamber (3), wherein the conveying duct (11) is connected, in a region adjoining the closure cap (4), to an annular distribution duct (13) which is connected to the drinking opening (6).

24 Claims, 10 Drawing Sheets

(58) Field of Classification Search
USPC ..... 220/709
See application file for complete search history.

(56) References Cited

U.S. PATENT DOCUMENTS

| | | | | |
|---|---|---|---|---|
| 4,442,948 | A | 4/1984 | Levy et al. | |
| 6,112,919 | A * | 9/2000 | Ho | 215/11.4 |
| 6,305,570 | B1 * | 10/2001 | Atkin et al. | 220/714 |
| 6,755,318 | B2 | 6/2004 | Burke et al. | |
| 7,210,596 | B1 | 5/2007 | Ruccolo | |
| 2003/0019876 | A1 | 1/2003 | Burke et al. | |
| 2006/0006182 | A1 | 1/2006 | Raft | |
| 2006/0060591 | A1 | 3/2006 | Rohrig | |

FOREIGN PATENT DOCUMENTS

| | | | |
|---|---|---|---|
| WO | 2004065247 | A1 | 8/2004 |
| WO | 2006019948 | A2 | 2/2006 |

OTHER PUBLICATIONS

Austrian Office Action Annual No. 3A A 50181/2012-1; dated Oct. 30, 2012.
International Search Report Appln. No. PCT/AT2013/050108; dated Sep. 18, 2013.
First Chinese Office Action dated Sep. 28, 2015; Appln. No. 201380033280.2 . . . (Machine Translation).

* cited by examiner

DRINKING DEVICE WITH A CONVEYING MEANS

The invention relates to a drinking device with a closure cap having a drinking opening and intended for closing a drinking container, which has a receiving chamber for liquid, and with a conveying means for conveying liquid from the receiving chamber, wherein the conveying means has an inner wall element which is received in an outer wall element so as to form a space, wherein the space defines a conveying duct between the wall elements, which is connected to the receiving chamber via an inlet opening.

A drinking container for children is known from U.S. Pat. No. 7,210,596 B1, having a substantially cylindrical outer container into which a corresponding insert is inserted. The insert has spacer elements on its outer wall so a cavity is formed between the insert and the outer container. In addition, the insert is offset from the bottom of the outer container via feet so liquid can flow into the cavity. At the open end of the outer container, a cup-shaped lid is attached, provided with a plurality of openings at the bottom for dispensing the liquid flowing through the cavity between the outer container and the insert. This design is intended to facilitate learning how to drink from a cup for children. However, the use of the container is comparably inconvenient since the cup-shaped lid needs to be pivoted over a comparably large angle in order to draw liquid. A further disadvantage of this design is that after entering the cup-shaped lid the liquid flows to the dispensing opening at the top in a substantially uncontrolled manner, thus making a precise drawing of liquid difficult.

U.S. Pat. No. 4,442,948 A discloses a drinking container consisting of two sleeves fit into one another. A helical liquid duct leading to an outlet at the rim of the cup is defined between the outer and the inner sleeve.

U.S. Pat. No. 4,016,998 A relates to a drinking container with a drinking straw integrated into it. The drinking straw connects a drinking opening at the top to an inlet opening at the bottom via two separate ducts.

Furthermore, US 2006/0006182 A1 shows a drinking bottle for children having a drinking appendage, which is connected to an opening in the bottom region of the drinking bottle via a duct.

From U.S. Pat. No. 6,755,318 B2 a different drinking container for dispensing a dosed amount of liquid when pivoted to a drinking position is known. The drinking container has an inner part having a drinking appendage and inserted into a central part that itself is received in an outer part. The space between bottom and side walls of the inner and the central part defines a chamber for receiving the dosed amount of liquid. The chamber is connected to the supply of liquid in the outer part via a narrow opening, which is positioned above the liquid level when pivoted sufficiently, so further flowing of liquid into the chamber is avoided. In most cases, however, a dosage of the liquid dispensed is not desired; moreover, this device also requires the container to be pivoted to a drinking position as is the case when drinking from a cup.

In contrast to this, the object of the present invention is to provide a drinking device of the type mentioned at the beginning with a simple design and economical in production, which is improved with regard to the aforementioned drawbacks of known drinking containers. Accordingly, the user of the drinking device should be allowed, in particular, to accurately control the transfer of liquid between the receiving chamber and the drinking opening when drinking.

In the drinking device of the type mentioned at the beginning this is achieved by connecting the conveying duct, in a region adjoining the closure cap, to an annular distribution duct that is connected to the drinking opening.

During use of the drinking device, the liquid flows from the receiving chamber into the conveying duct between the wall elements and then into the annular distribution duct, which defines a circumferential cavity for distributing the liquid flowing in, which is connected to the drinking opening. Advantageously, the annular distributing duct is connected to the conveying duct over its entire circumference so a uniform influx of liquid may be obtained. The drinking device allows an accurate, well-controllable guiding of the liquid flow between the receiving chamber and the drinking opening, at which the desired amount of liquid is reliably provided. The annular distribution duct guarantees that liquid is supplied to the drinking opening in a uniform manner when drinking. In addition, liquid may be drawn for a wide variety of drinking positions, increasing the user friendliness of the drinking device considerably. For this, it is particularly favourable if the space between the outer wall element and the inner wall element is designed as a gap in such a way that liquid flows through the conveying duct into the annular distribution duct against gravity when suction pressure is applied to the drinking opening. This makes it possible to use the drinking device like a conventional drinking straw. An advantage of this design is that the drinking device may be used independently from the position of the drinking container, i.e. also in a vertical and/or non-pivoted position. In this way, a variably usable drinking device with high user friendliness is created, providing a well-controllable drawing of liquid as well. Since the drinking opening is arranged within the closure cap, accidental spilling of liquid is basically avoided.

For a uniform distribution of the liquid in the annular distribution duct it is favourable if the extension plane of the distribution duct is arranged substantially parallel to a lower placing surface of the drinking container. This guarantees a uniform distribution of the liquid flow when the drinking container is arranged in a substantially upright and/or non-pivoted position.

In order to form the annular distribution duct in the region adjoining the closure cap, it is advantageous if the annular distribution duct is formed by a circumferential clearance and/or recess that is delimited at least by closure-sided end regions of the wall elements of the conveying means; in the upward direction, the distribution duct may be delimited by an additional seal, in particular a silicone seal, provided on the inner surface of the closure cap.

In order to connect the annular distribution duct to the conveying duct of the conveying means in a way simple in design, it is favourable if the outer wall element of the conveying means has a circumferential flange in the closure-sided end region, with a clearance that is open in particular towards the inner surface of the closure cap. Accordingly, the circumferential flange extends from the outer wall element of the conveying means to the outside in a radial direction. Advantageously, the annular distribution duct thus has a larger width and/or radial extension than the conveying duct between the outer and the inner wall element. For delimiting the annular distribution duct radially to the outside, a circumferential protrusion of the flange extending in the longitudinal direction is preferably provided. For delimiting the annular distribution duct radially to the inside, an extension of the inner wall element in the axial direction is preferably provided.

For the uniform conveying of liquid from the receiving chamber it is advantageous if the wall elements are formed rotationally symmetrically with respect to their longitudinal axes. In a preferred design, the longitudinal axis of the outer wall element coincides substantially with the longitudinal axis of the inner wall element. Thereby, a conveying duct having a substantially consistent width in the circumferential direction of the conveying duct is obtained; preferably, the conveying duct also has a substantially consistent width over its entire length between the inlet opening and the annular distribution duct.

Furthermore, it has proven advantageous if the inner wall element rests on at least three, preferably six, points on the outer wall element spaced apart in the circumferential direction, which points are preferably formed by supporting lugs moulded on the outer wall element. In this way, contact between the inner and the outer wall element between the supporting points may be avoided, and the cross-section of a transition from the conveying duct to the distribution duct may be kept substantially equal to the cross-section of the conveying duct so the passing of a liquid from the conveying duct and/or from the space between the wall elements to the distribution duct is facilitated.

In a preferred embodiment, a substantially conical shape of the wall elements, tapering from closure-sided end regions to bottom-sided end regions, is provided. Alternatively, a substantially cylindrical shape of the wall elements may be provided.

In order to convey liquid reliably into the conveying duct between the wall elements in any inclined position of the drinking container, it is advantageous if the inlet opening is arranged circumferentially between bottom-sided end regions of the wall elements of the conveying means. The fact that the inlet opening extends between bottom-sided end regions of the wall elements allows a virtually complete emptying of the receiving chamber by means of the conveying means; in addition, the circumferential inlet opening guarantees that liquid may flow into the conveying duct regardless of the position of the drinking container during the drinking procedure.

To be able to substantially empty the receiving chamber of the drinking container completely using the drinking device, it is advantageous if the inlet opening leading to the conveying duct adjoins a bottom of the drinking container.

In order to avoid liquid leaking from the drinking container, it is favourable if the drinking opening has a valve, in particular a slit diaphragm opening under suction pressure.

In order to reliably obtain a liquid-tight connection between the drinking container and the closure cap, it is favourable if a sealing element is arranged between the drinking container and the closure cap in the state of the closure cap being attached to the drinking container.

In this context, it has proven favourable if the closure cap has a clearance, so an air gap remains between the closure cap and the sealing element in the region of the clearance. Cooperating with an air inlet opening, if applicable, the air gap allows a pressure compensation in the drinking container, as described below. If the clearance is provided in only one point, preferably opposite the drinking opening, the tightness of the container is hardly compromised. For example, the clearance may be provided in the form of a groove in a wall of the closure cap that otherwise terminates in the sealing element.

In order to prevent that an undesirably high negative pressure builds up in the drinking container, it is advantageous if the closure cap has an air inlet opening. In order to allow air entering only via the air inlet opening while avoiding an undesired leaking of liquid, it is advantageous if a sealing flap is added to the air inlet opening for forming a venting valve. The sealing flap may in particular be provided in the region of the air inlet opening only, so a material-saving economical design is obtained. Alternatively, a circumferential sealing lip may also be provided instead of the sealing flap, which is only formed locally.

When using a sealing element as specified above, the sealing flap may advantageously be formed integrally with the sealing element, wherein the sealing flap preferably contacts the closure cap under tension. Accordingly, the sealing element forms an one-way valve, at least in certain sections, preventing—according to a sealing function—the leaking of liquid, on the one hand, and allowing—according to a venting function—the pressure compensation by supplying air from the outside to the drinking container at the same time. Since the sealing element is circumferential anyway, a circumferential sealing lip contacting the closure cap under tension may be formed by the sealing element in a simple manner. An air duct, preferably a circumferential one, between the sealing element and the closure cap may also be provided here, so a pressure compensation may be performed at any point along the sealing lip and basically independently from the spatial position of the drinking device and/or its inclination.

Another preferred way of sealing the air inlet opening is to add a shield valve to the air inlet opening in order to form a venting valve. The shield valve allows further saving of material and also increases the reliability of the venting valve since it is less susceptible to fatigue than a flap valve.

Furthermore, it is favourable for a user-friendly drawing of liquid if a preferably straw-shaped mouthpiece having the drinking opening is connected to the closure cap. Moreover, it is advantageous if the mouthpiece is made of a resilient material, preferably silicone. Regarding a small number of parts and thus an economical design, it is favourable if the mouthpiece is formed integrally with the sealing element.

Provided that a rotatably supported cover, having at least one clearance and cooperating with the mouthpiece, is connected to the closure cap, the cover may be positioned in a drinking position such that the resilient mouthpiece protrudes through the clearance. Otherwise the mouthpiece may also be arranged in a storing position between the cover and the closure cap when rotating the cover.

In a particularly preferred embodiment of the invention an outer wall of the drinking container is provided as the outer wall element of the conveying means. According to this, the drinking device is integrated into the drinking container in this design. Advantageously, the inner wall element is formed thin-walled so arranging the conveying means within the drinking container reduces the receiving volume of the receiving chamber only slightly. In use, the space between the outer wall and the inner wall element is filled at least partially by air, so a very good thermal insulation of the liquid contained in the receiving chamber is obtained. For this, it is favourable if the space between the outer wall and the inner wall element is formed as a narrow gap so the stored liquid of the drinking container enters the conveying duct only a little. Accordingly and with regard to a good insulating effect of the drinking device, the conveying duct is filled by air at least in certain sections; for drawing liquid from the receiving chamber, suction pressure may be applied to the drinking opening, inducing a flowing of liquid into the conveying duct while displacing the air contained therein.

For filling and/or refilling the drinking container it is advantageous if the outer wall of the drinking container has connecting means, in particular a thread or a part of a bayonet coupling, for the releasable connection to corresponding connecting means of the closure cap. If the annular distribution duct is formed at closure-sided end regions of the wall elements integrated into the drinking container, this design makes it possible to gain the advantage that the connection carrying the liquid between the drinking opening and the annular distribution duct is established independently from the relative position of the releasable connecting means to one another.

In an alternative preferred embodiment, it is provided that the closure cap and the conveying means form an insert part for a separate drinking container. In a position for use, the drinking device is attached to the drinking container; thus the drinking container does not form part of the drinking device in this embodiment. As a consequence, the drinking container has at least one outer wall that is discrete from the wall elements of the drinking device, surrounding the receiving chamber with a bottom region.

In order to attach the drinking device to the separate drinking container, it is favourable if the insert part has connecting means for a releasable connection to the separate drinking container. Preferably, the closure cap of the insert part has a dome-shaped connecting element, which fits the closure-sided end region of the separate drinking container, in the form of a coupling cap, advantageously including a thread.

For obtaining a conveying means of the drinking straw type, it is favourable if the insert part has an elongated, straw-like conveying means which preferably protrudes centrally into the receiving chamber of the separate drinking container during use. In order to be able to draw liquid inside the conveying means as well, it is advantageous if the inner wall element includes a cavity.

The invention is discussed in further detail by means of preferred embodiments illustrated in the figures below, but without being limited to them.

Figure 4:
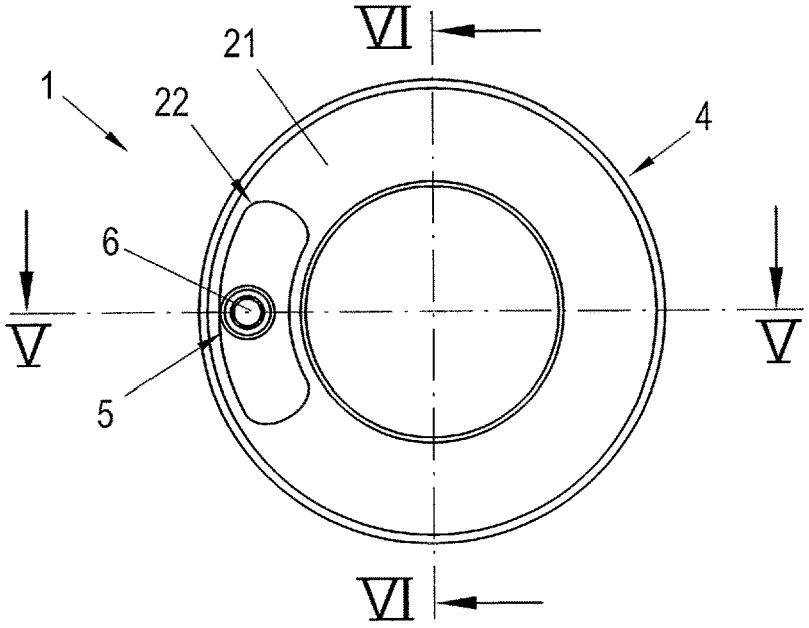
FIG. 4 shows a plan view of a drinking container having a drinking device according to a third embodiment with a shield valve.
Figure 9A:
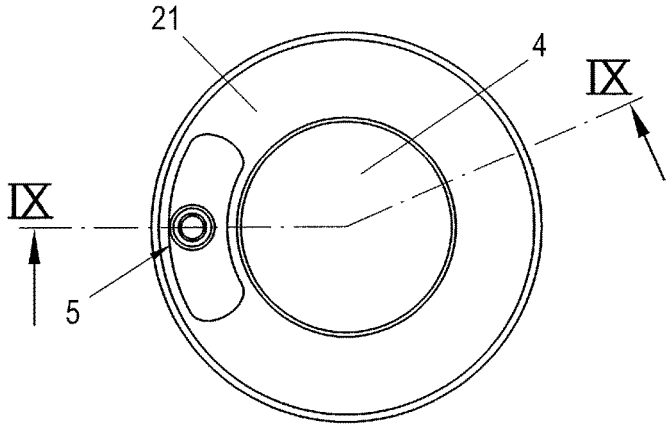
Figure 9B:
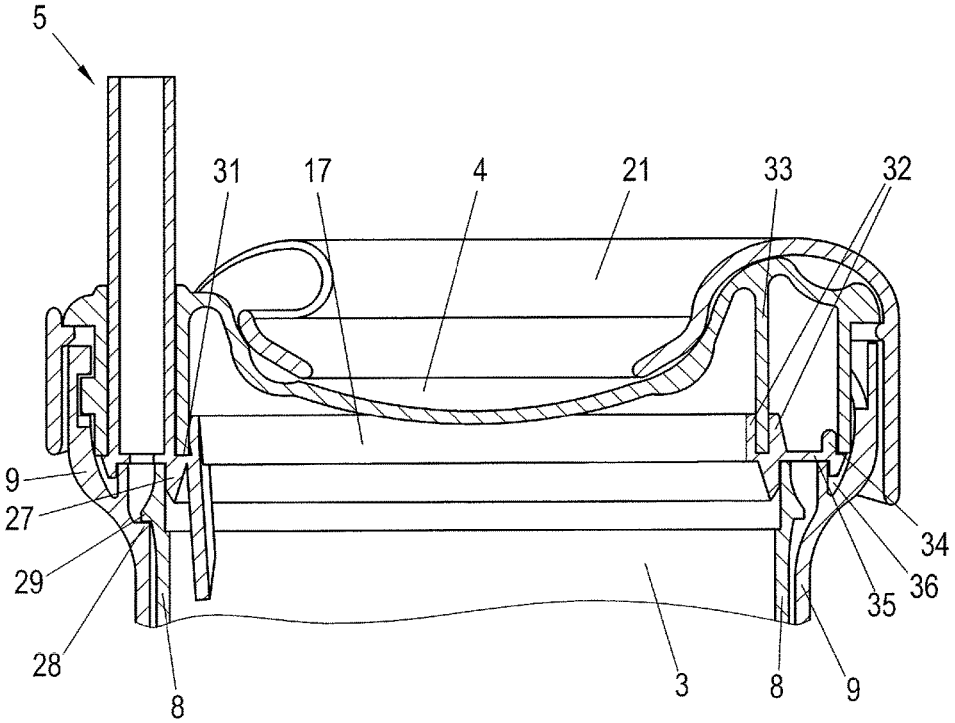
Figure 9C:
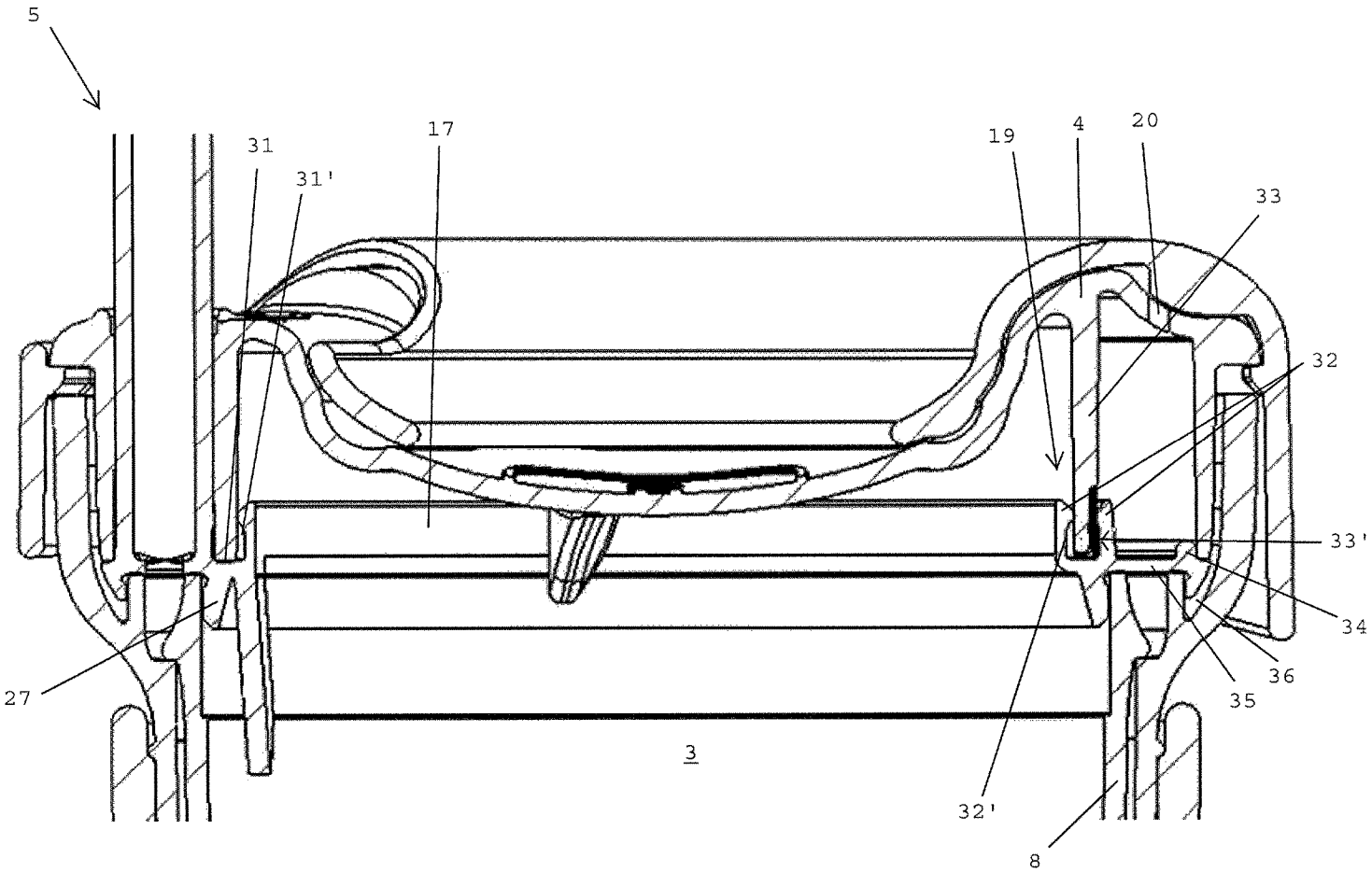
Figure 10:
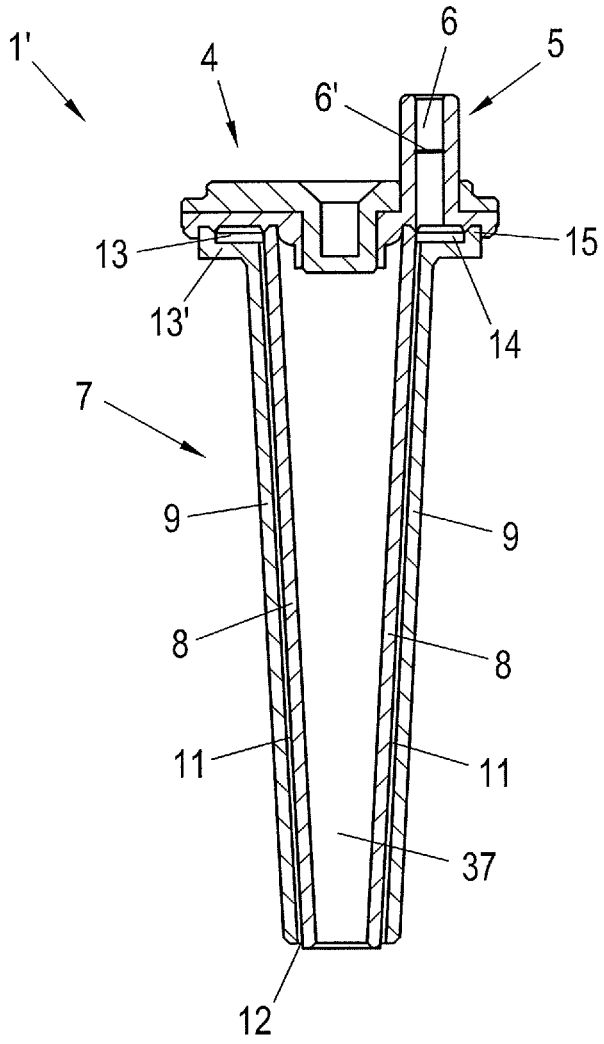
Figure 11:
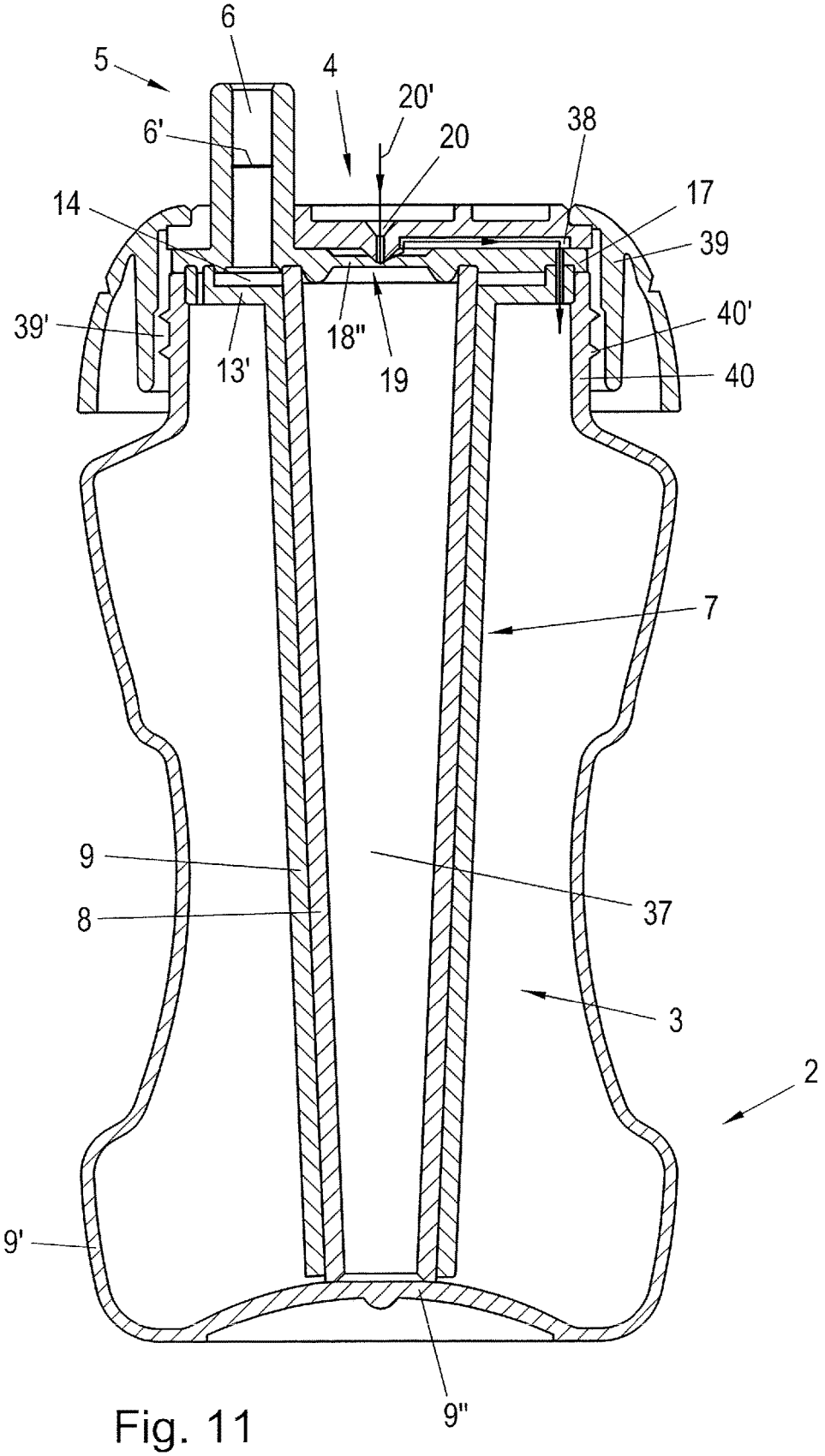
Figure 14:
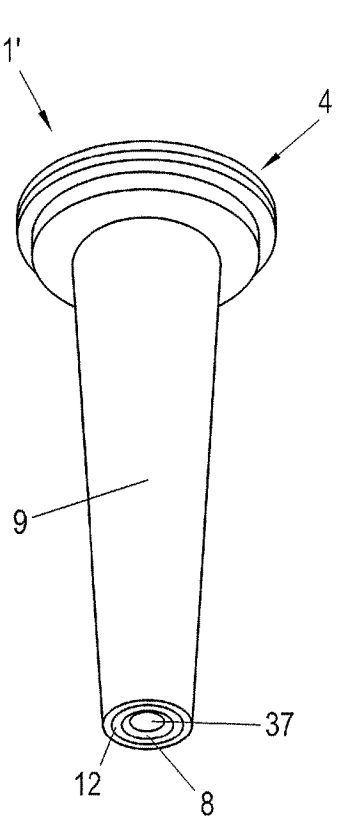
Figure 13:
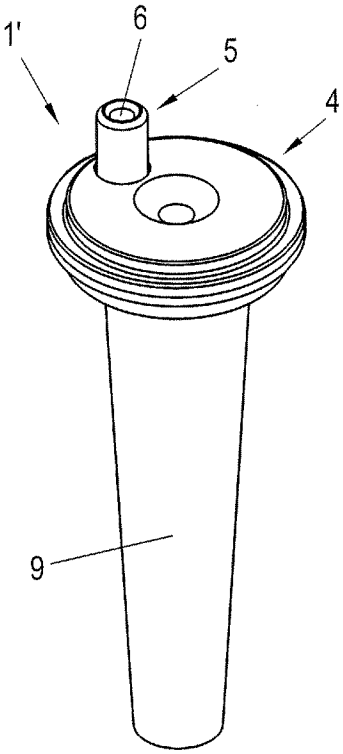
Figure 12:
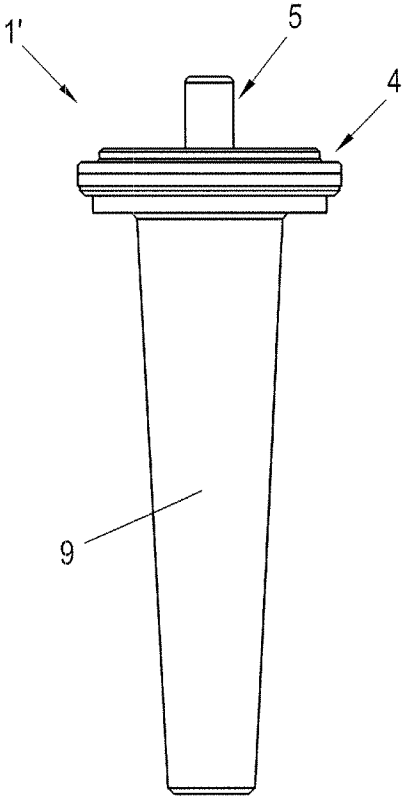

FIG. 9*a* shows a plan view and FIG. 9*b* shows an angular section view according to line IX-IX in FIG. 9*a* of an upper part of a drinking container having a drinking device according to a fourth embodiment;

FIG. 9*c* shows a longitudinal section view of an upper part of a drinking container according to a fifth embodiment, wherein the section is analogous to line V-V in FIG. 4;

FIG. 10 shows a section view of a drinking device which is designed, according to a fifth embodiment, as an insert part for a separate drinking container;

FIG. 11 shows a section view of a drinking container with a drinking device according to FIG. 10 inserted therein;

FIG. 12 shows a lateral view of the drinking device illustrated in FIG. 10; and FIGS. 13 and 14 each show a respective schematic view of the drinking device illustrated in FIGS. 10 and 12.

Figure 1:
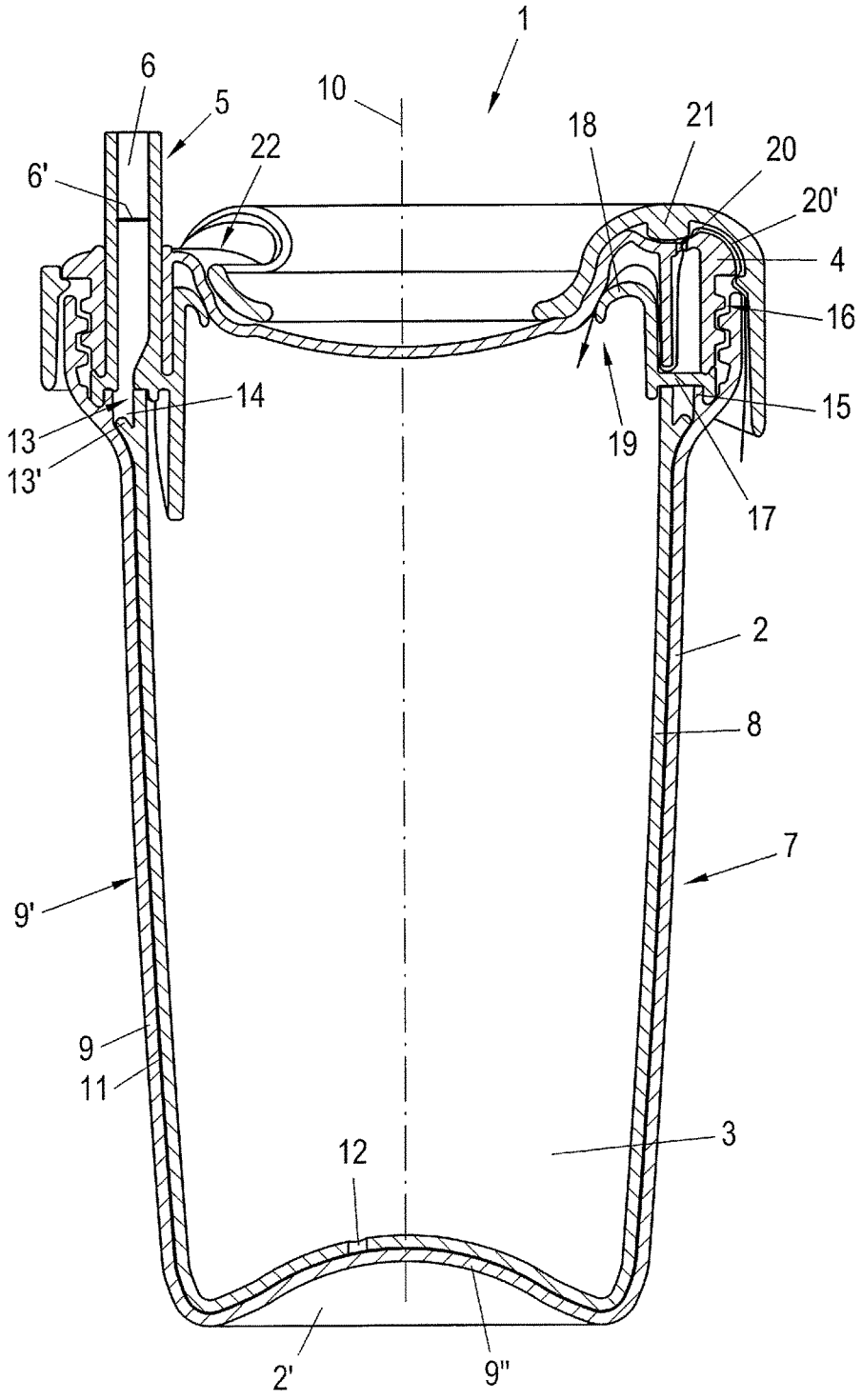
FIG. 1 shows a longitudinal section view of a drinking container having a drinking device according to a first embodiment of the invention.

FIG. 1 shows a first embodiment of a drinking device 1 for a drinking container 2 including a receiving chamber 3 for liquid. The drinking device 1 has a removable closure cap 4 with a mouthpiece 5 having a drinking opening 6. Furthermore, a conveying means 7 is provided, set up to convey liquid from the receiving chamber 3 to the drinking opening 6. The conveying means 7 has an inner wall element 8, which is arranged within an outer wall element 9. In the design shown in FIGS. 1 to 3, the outer wall element 9 is formed by an outer wall 9' of the drinking container 2, which defines the receiving chamber 3 together with a bottom 9" that is formed integrally with the outer wall 9'. The inner wall element 8 is held over the closure cap 4 in the outer wall element 9. Advantageously, the conveying means 7 and the closure cap 4 are made of a hard plastic material.

As can further be seen in FIG. 1, the wall elements 8, 9 are formed substantially rotationally symmetrically with respect to a common longitudinal axis 10, which constitutes the longitudinal axis of the drinking container 2 at the same time. In the exemplary embodiment shown, the wall elements 8, 9 have a substantially conical shape tapering from closure-sided end regions to bottom-sided end regions.

As can further be seen in FIG. 1, the wall elements 8, 9 of the conveying means 7 surround a space defining a conveying duct 11 for the transfer of liquid. Having a consistent width, the conveying duct 11 extends over the entire length of the wall elements 8, 9, so a uniform flow of liquid is ensured. The conveying duct 11 is connected to the receiving chamber 3 via an inlet opening 12 adjoining the bottom 9" of the drinking container 2. The conveying duct 11 between the wall elements 8, 9 is designed as a narrow gap having a width of approx. 0.3 to 0.5 mm, which is usually filled by air, so the liquid contained in the receiving chamber 3 is thermally insulated. In this way, a drinking container 2 is provided, which is particularly well suited for maintaining the temperature of a beverage contained in the receiving chamber 3, i.e. in particular a hot or cold beverage. When applying negative pressure to the mouthpiece 5, liquid flows from the receiving chamber 3 via the inlet opening 12 into the conveying duct 11, displacing the air that is normally contained in the conveying duct 11. As a consequence, liquid may be drawn in a straw-like manner from the receiving chamber 3 to the drinking opening 6 of the mouthpiece 5 by means of the conveying means 7 in the drinking container 2. In order to avoid an undesired leaking of liquid, the drinking opening 6 has a valve 6'. Advantageously, a flexible slit diaphragm is provided as the valve 6', closing the drinking opening 6 under normal pressure but forming an opening when suction pressure is applied, so liquid may pass through it.

As can further be seen in FIG. 1, in a region adjoining the closure cap 4, the conveying duct 11 is connected to an annular distribution duct 13 which is connected to the drinking opening 6 formed in the mouthpiece 5. When applying suction pressure to the mouthpiece 5, the liquid guided through the conveying duct 11 in the longitudinal direction flows, via a circumferential through hole, into the annular distribution duct 13, which is thus supplied with liquid by the conveying duct 11 over its entire circumference. The extension plane of the distribution duct 13 is arranged substantially parallel to a lower placing surface 2' of the drinking container 2, so in a horizontal position of the drinking container 2 a uniform flow of liquid into the annular distribution duct 13 occurs. For forming the annular distribution duct 13, a circumferential protruding flange 13' having a recess and/or clearance 14, by which the distribution duct 13 is formed, is provided in closure-sided end regions of the wall elements 8, 9. The distribution duct 13 is delimited radially to the outside by the circumferential protrusion and/or flange 15, which is arranged in the longitudinal direction of the drinking container 2; for delimiting the distribution duct 13 radially to the inside, an extension of the inner wall element 8 is provided.

As can further be seen in FIG. 1, the closure cap 4 is releasably attached to the drinking container 2 by means of a threaded connection 16. The outer wall 9' of the drinking container 2 has a thread which engages a corresponding thread of the closure cap 4. Of course, however, the closure cap 4 may also be connected to the drinking container 2 via a snap-on connection or the like.

A seal 17 is arranged between the closure cap 4 and the drinking container 2, so an undesired leaking of liquid via the thread 16 is avoided. In addition, a circumferential sealing lip 18, contacting the closure cap 4 under tension, is formed integrally with the seal 17; in this way, a venting valve 19 is formed, via which a controlled entering of air in the direction of the arrow 20' may occur through an air inlet opening 20 provided in the closure cap 4 and into the receiving chamber 3. The venting valve 19 is adapted with respect to the drinking valve 6' such that after releasing suction pressure for drinking, a small negative pressure remains, so liquid is drawn back into the drinking container 2.

Moreover, the mouthpiece 5 is formed integrally with the seal 17 and is thus resiliently deformable. Due to this and by means of a cover 21, which is rotatably supported on the closure cap 4 and has a clearance 22, the mouthpiece 5 may be positioned either in the drinking position shown in FIG. 1 or—provided the cover 21 is arranged such that the clearance 22 is not arranged in the region of the mouthpiece 5—in a depressed storing position between the closure cap 4 and the cover 21.

Figure 2:
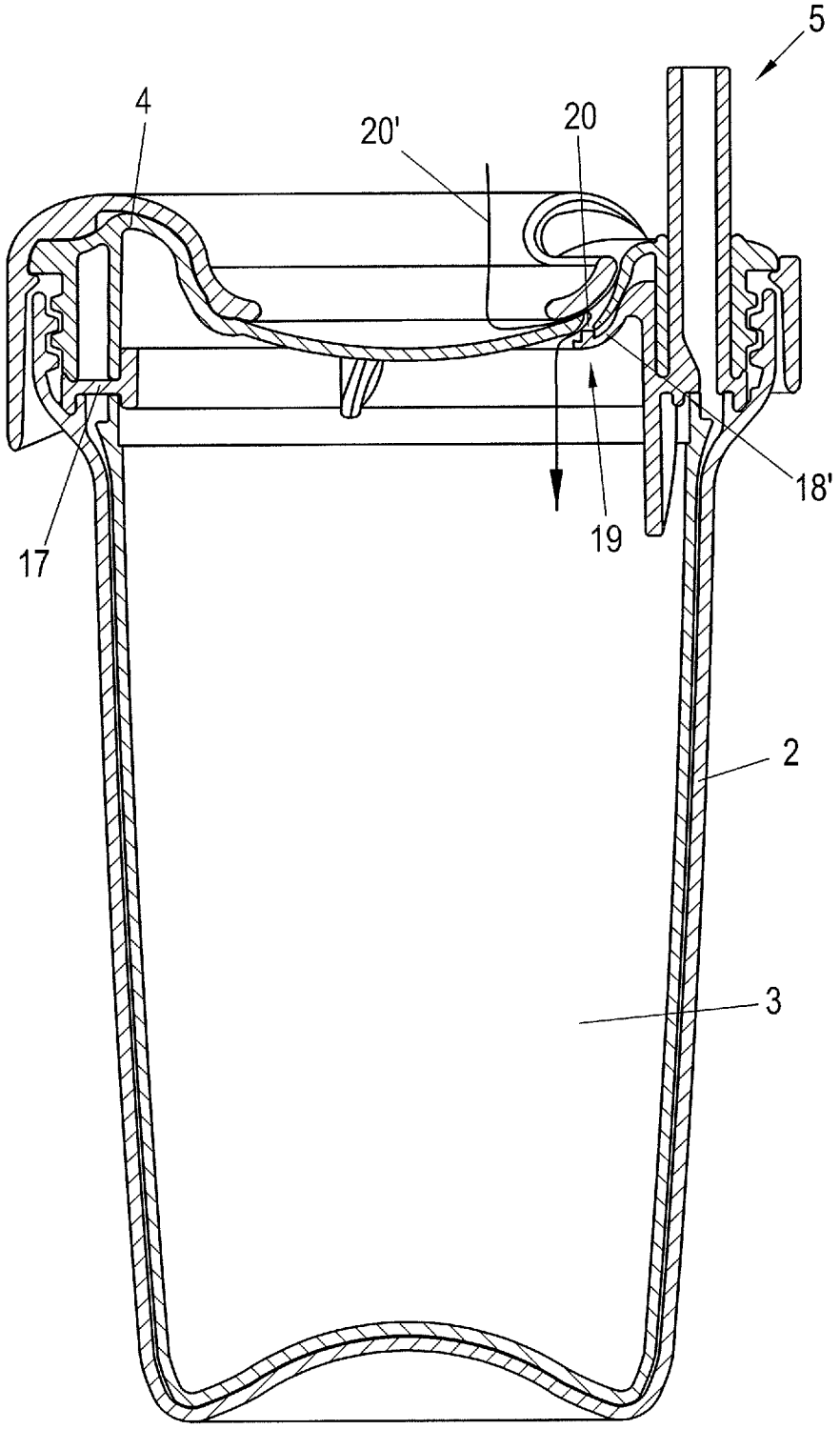
FIG. 2 shows a longitudinal section view of a drinking container having a drinking device according to a second embodiment.

FIG. 2 shows an alternative design of the venting valve 19. Here, a circumferential sealing lip 18 as in the design according to FIG. 1 is not provided. The closure cap 4 is connected to the drinking container 2 substantially air-tight via the seal 17. In the region of the mouthpiece 5, however, the closure cap 4 has an air inlet opening 20, so air may enter the receiving chamber 3 in the direction of the arrow 20'. The entering of air is controlled by a sealing flap 18', which is provided only in the region of the air inlet opening 20 and formed integrally with the seal 17 and/or the mouthpiece 5, and which contacts the closure cap 4 under tension, thus closing the air inlet opening 20 in case of equal pressure levels inside and outside of the receiving chamber 3. Provided that a certain negative pressure is present in the receiving chamber 3 due to suction pressure being applied to the mouthpiece 5, the sealing flap 18' rises from the closure cap 4 and thus enables an entering of air via the air inlet opening 20 for pressure compensation. In this design of the venting valve 19, it is particularly advantageous that a considerable saving of material with respect to the circumferential sealing lip 18 shown in FIG. 1 may be obtained due to the sealing flap 18' being provided only in the region of the air inlet opening 20.

Figure 6:
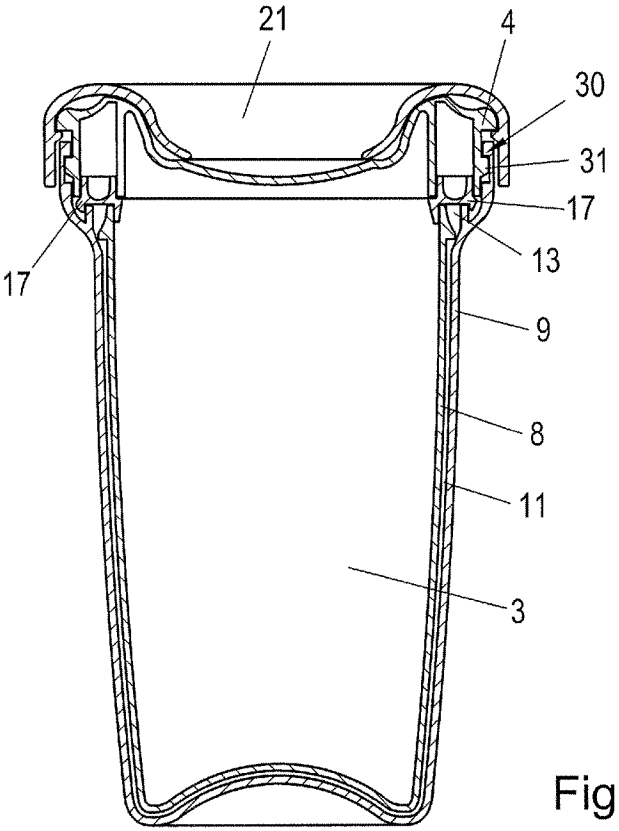
FIG. 6 shows a longitudinal section view of the drinking container according to FIG. 4 along line VI-VI in FIG. 4.
Figure 5:
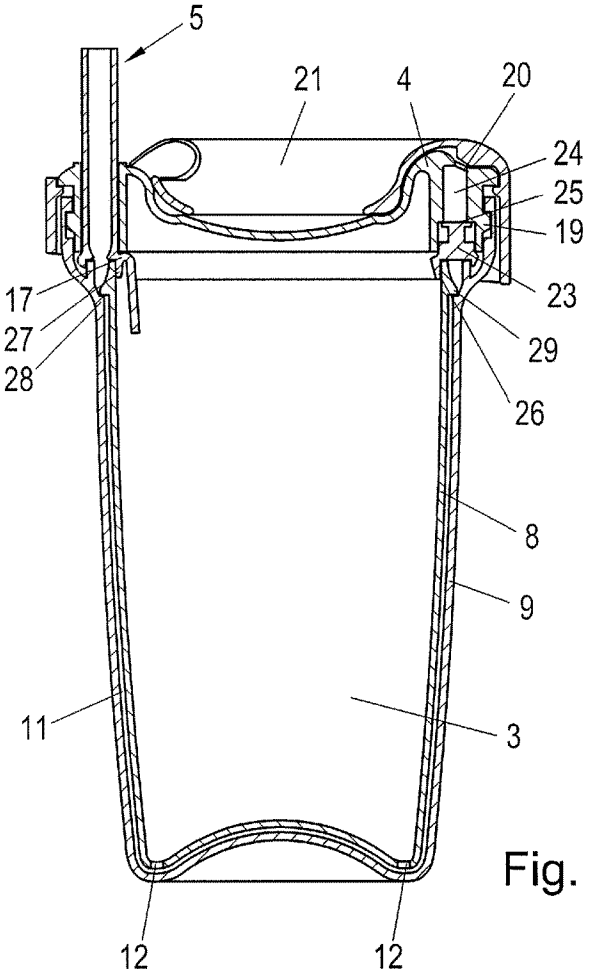
FIG. 5 shows a longitudinal section view of the drinking container according to FIG. 4 along line V-V in FIG. 4.

FIGS. 4 to 6 show a basically similar embodiment of the drinking device 1 according to FIG. 1 or FIG. 2, wherein the venting valve 19 is formed by a shield valve. The shield valve comprises an inner shield part 23, which seals a valve chamber 24 formed in the closure cap 4. The shield part 23 is formed integrally with the seal 17 and the mouthpiece 5 and is thus resiliently deformable. The valve chamber 24 has the shape of a stepped cylinder, wherein a lower part of the valve chamber 24 is set up for receiving the shield part 23 and the cross-section of an upper part is tapered with respect to the lower part such that an outer edge 25 of the shield part (cf. FIG. 7) tightly contacts the step formed in the valve chamber 24. The upper part of the valve chamber is connected to an air inlet opening 20, so the air pressure in this part is equal to the ambient pressure. The lower part of the valve chamber 24 is connected to the receiving chamber 3 via a clearance 26 in the shield part and/or in the seal 17. Once pressure in the receiving chamber 3 drops below a certain level, the shield part 23 deforms such that its outer edge 25 rises from the step in the valve chamber 24 and air from the upper part may pass into the lower part of the valve chamber 24. Conversely, the tight termination of the shield part 23 by the valve chamber 24 prevents liquid contained in the receiving chamber 3, for example, from getting to the outside through the valve chamber 24.

In addition to the different venting valve 19, the seal 17 in the embodiment shown in FIGS. 4 to 6 has a collar 27 under tension, which terminates tightly with the inner wall element 8. The collar 27 extends over the entire circumference of the seal and contacts the inner side of the inner wall element 8 under tension as it has a shape that substantially expands conically in a downward direction and is resiliently deformed due to its arrangement within the inner wall element 8.

Figure 8:
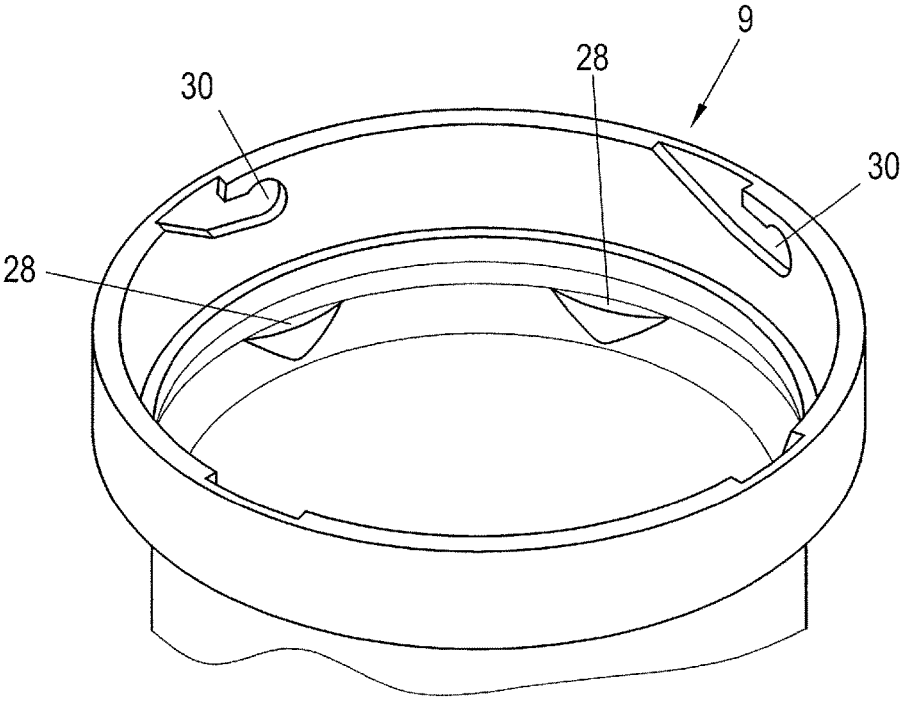
FIG. 8 shows a schematic view of an outer wall element of the drinking container according to FIG. 4.

As can be seen by comparing FIG. 5 and FIG. 6 and as illustrated in detail in FIG. 8, the inner wall element 8 is hung up within the outer wall element 9 in at least three, preferably six, sections. The hanging may be obtained by supporting lugs 28 (cf. FIG. 8) moulded on the inner side of the outer wall element 9, for example, on which supporting lugs sections of an oppositely protruding flange 29 of the inner wall element 8 rest. The protruding flange 29 is formed rotationally symmetrically over the entire circumference of the inner wall element 8 while the supporting lugs 28 are spaced apart, so the conveying duct 11 between the wall elements 8, 9 extends substantially unobstructed into the distribution duct 13 in the regions between the supporting lugs 28, as can best be seen in FIG. 6.

In the exemplary embodiment illustrated in FIG. 5, the inner wall element 8 has at least two inlet openings 12, which connect the conveying duct 11 to the receiving chamber 3. The inlet openings 12 are provided in the deepest points of the inwardly bulged bottom 9" in order to allow a complete emptying of the receiving chamber 3.

As can be seen in FIG. 8 as well as in FIGS. 5 and 6, in the exemplary embodiment shown here the closure cap 4 is attached releasably to the drinking container 2 and/or the outer wall element 9 by means of a turn-latch connection, preferably by means of a bayonet coupling. The outer wall element 9 of the drinking container 2 has latching grooves 30 into which the corresponding connecting elements 31 of the closure cap 4 may be inserted.

In the exemplary embodiment shown in FIGS. 9*a*, 9*b* and 9*c* the seal 17 also has a collar 27, which extends from a sealing plane defined by the upper edge of the inner wall element 8 down to the bottom 9" (not shown). In addition, the seal 17 forms a sealing groove 31, which is formed by concentric sealing rings 32 extending from the sealing plane up to the closure cap 4. The sealing rings 32 are formed integrally with the seal 17. An inner, vertical wall 33 of the closure cap 4 is received tightly in the sealing groove 31, so a leaking of liquid from the receiving chamber 3 between the inner wall element 8 and the closure cap 4 is prevented by the seal 17. Accordingly, a radially outer sealing ring 34 of the seal 17 may be designed smaller with respect to the exemplary embodiment illustrated in FIG. 6. In the seal shown in FIGS. 9*b* and 9*c*, the radially outer sealing part 35 is mainly set up for sealing the space between the inner wall element 8 and the outer wall element 9 and is in engagement with a groove 36 formed by the outer wall element 9 for this purpose.

Figure 7:
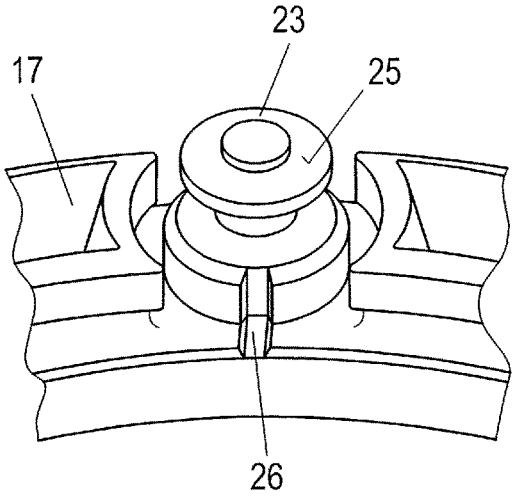
FIG. 7 shows a schematic detail view of the shield valve according to FIG. 4.

In the exemplary embodiment shown in FIG. 9*b*, a shield valve formed by the seal 17 according to FIG. 7 is preferably provided for pressure compensation. It may in particular be arranged at a side opposite the mouthpiece 5, so it is not illustrated in the angular section view shown because of the selected angle (cf. FIG. 9*a*).

In contrast to FIG. 9*b*, FIG. 9*c* shows a planar longitudinal section view. In contrast to FIG. 9*b*, the radially inner sealing ring 32 of the seal 17 is formed as a type of a circumferential sealing lip and thus forms a sealing flap 32' which contacts the vertical wall 33 of the closure cap 4 on the inside under tension. In order to allow an entering of air between the wall 33 and the sealing flap 32', a clearance 33' in certain regions is provided at the closure cap 4, in particular on the radial outside as well as at the lower edge of the vertical wall 33. The clearance 33' is preferably provided at a point of the closure cap 4 opposite the mouthpiece 5. It may in particular be formed as a type of a vertically and/or radially extending groove or notch in a wall of the closure cap 4. Due to the distance between the wall 33 and the seal 17 and/or the outer sealing ring 32, which is obtained via the clearance 33', an air gap is formed between the two elements, which communicates with an circumferential air duct 31' delimited by the sealing flap 32' and provided in the sealing groove 31. The air duct 31' extends in the bellied sealing groove 31, which is thus not completely filled by the wall 33 annular in plan view.

In order to avoid the build-up of negative pressure inside the closure cap 4, an air inlet opening 20 is provided in the region of the clearance 33' in the closure cap 4. During pressure compensation, air from outside flows through the air inlet opening 20, through the air gap formed by the clearance 33', into the air duct 31', and due to the pressure difference the sealing flap 32' is raised from the wall 33 in at least one point along the circumference, so the air from the air duct 31' enters the drinking container 3. In this way, the seal 17 and the closure cap form a venting valve 19.

FIGS. 10 to 14 show an alternative design of the drinking device 1 which is formed as an insert part 1' for a separate drinking container 2. The insert part 1' has an elongated conveying means 7 of the drinking straw type, which is arranged centrally within the receiving chamber 3 of the separate drinking container 2 in a position for use shown in FIG. 11. In this design, discrete wall elements 8, 9 with respect to the outer wall 9' of the container 2 are provided, which are formed funnel-shaped and tapered from an end region attached to the closure cap 4 to an opposite free end region. Advantageously, the insert part 1' is dimensioned such that, in the position for use, the wall elements 8, 9 protrude to a bottom 9" of the respective drinking container 2. In the exemplary embodiment shown, a bottom 9" bulged to the inside is provided. The inner wall element 8 surrounds a central cavity 37, so liquid may be received in this cavity 37 as well.

Figure 3:
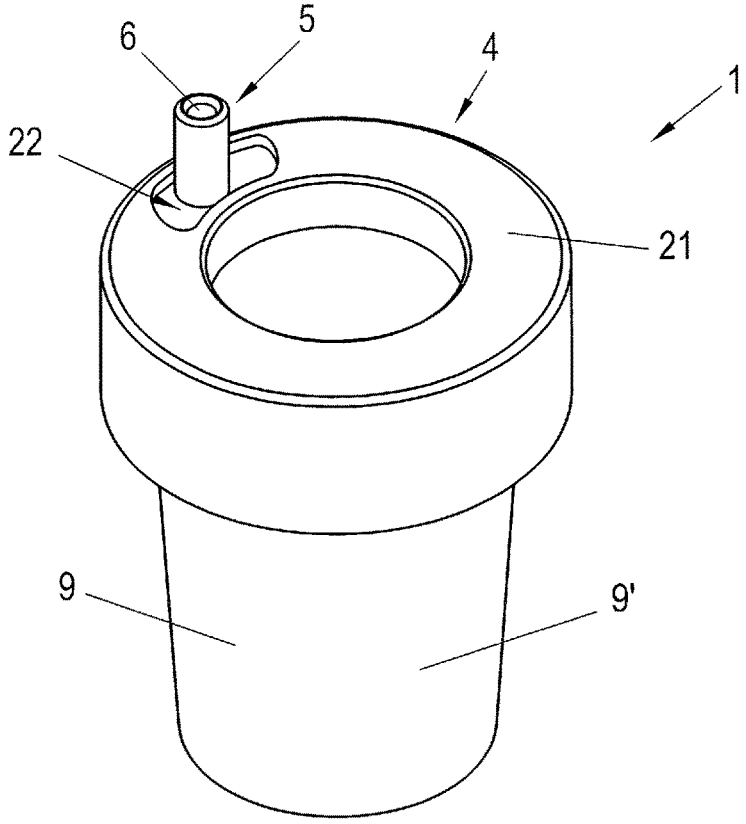
FIG. 3 shows a schematic view of the drinking container illustrated in FIG. 1.

As can be seen in FIGS. 10, 11, the conveying duct 11 between the wall elements 8, 9 and the annular distribution duct 13 adjoining the conveying duct 11 in the region of the closure cap 4 are designed substantially according to the exemplary embodiment discussed by means of FIGS. 1 to 3, so reference can be made to the above explanations. An angular end region of the outer wall element 9 is provided, having the circumferential flange 13' and the protrusion 15 for delimiting radially to the outside the annular distribution duct 13 designed in the form of a clearance 14.

A venting valve 19 is provided in this exemplary embodiment as well, cooperating with the drinking valve 6' such that when releasing suction pressure, negative pressure remains in the drinking container 2. The controlled entering of air in the direction of the arrow 20' occurs via the air inlet opening 20 to which a sealing diaphragm 18" is attached in the closed state of the venting valve 19; the sealing diaphragm 18" is formed integrally with the seal 17. When applying suction pressure, the sealing diaphragm 18" rises and air enters the receiving chamber 3 in the direction of the arrow 20' via a further air inlet opening 38 in the seal 17 and the outer wall element 9.

As can further be seen in FIGS. 10, 11, the insert part 1' has a dome-shaped connecting element 39 which is connectible to a container neck 40 of the separate wall element 9'; in FIGS. 12 to 14, the drinking device 1 is illustrated without the connecting element 39 for more clarity. For releasably connecting the insert part 1' to the separate drinking container 2, the dome-shaped connecting element 39 has an internal thread 39' that cooperates with an external thread 40' arranged on the container neck 40 in the position for use.

The invention claimed is:

1. A drinking device with a drinking container and a closure cap having a drinking opening and intended for closing a drinking container, the drinking device comprising a receiving chamber for liquid and a conveying means, wherein the conveying means has an inner wall element configured to be received in an outer wall element to form a space, wherein the space defines a conveying duct between the wall elements, wherein an annular distribution duct is provided in a region adjoining the closure cap, wherein the conveying means is configured to supply liquid from the receiving chamber into the annular distribution duct, wherein the conveying duct is connected to the receiving chamber via an inlet opening which adjoins a bottom of the drinking container and the conveying duct is connected to the annular distribution duct, and the annular distribution duct is connected to the drinking opening, wherein the space between the outer wall element and the inner wall element allows liquid to uniformly flow through the conveying duct into the annular distribution duct against gravity when suction pressure is applied to the drinking opening, wherein the annular distribution duct is formed by a circumferential protruding flange having a clearance and/or recess and defines a circumferential cavity for distributing the liquid flowing in, wherein the annular distribution duct is delimited by closure-sided end regions of the wall elements of the conveying means, and wherein the outer wall element of the conveying means has a circumferential flange in the closure-sided end region, with a clearance that is open in particular towards the closure cap, and wherein the outer wall element is formed by an outer wall of the drinking container, which defines the receiving chamber together with the bottom that is formed integrally with the outer wall.

2. The drinking device according to claim 1, wherein an extension plane of the annular distribution duct is arranged substantially parallel to a lower placing surface of the drinking container.

3. The drinking device according to claim 1, wherein the wall elements are formed rotationally symmetrical with respect to their longitudinal axes.

4. The drinking device according to claim 1, wherein the inner wall element rests on at least three points on the outer wall element spaced apart in a circumferential direction, wherein the at least three points are formed by supporting lugs moulded on the outer wall element.

5. The drinking device according to claim 4, wherein the wall elements have a conical shape tapering from closure-sided end regions to bottom-sided end regions.

6. The drinking device according to claim 1, wherein the drinking opening has a valve formed as a slit diaphragm, configured to open under suction pressure.

7. The drinking device according to claim 1, wherein a sealing element is arranged between the drinking container and the closure cap when the closure cap is attached to the drinking container.

8. The drinking device according to claim 7, wherein the closure cap has a clearance, and an air gap is formed between the closure cap and the sealing element in the region of the clearance.

9. The drinking device according to claim 7, wherein the sealing flap is formed integrally with the sealing element, and wherein the sealing flap contacts the closure cap under tension.

10. The drinking device according to claim 7, wherein a mouthpiece having the drinking opening is connected to the closure cap.

11. The drinking device according to claim 10, wherein the mouthpiece is made of a resilient material and is formed integrally with the sealing element.

12. The drinking device according to claim 1, wherein the closure cap has an air inlet opening.

13. The drinking device according to claim 12, wherein a sealing flap is added to the air inlet opening to form a venting valve.

14. The drinking device according to claim 13, wherein a rotatably supported cover, having at least one clearance and cooperating with the mouthpiece, is connected to the closure cap.

15. The drinking device according to claim 12, wherein a shield valve is added to the air inlet opening to form a venting valve.

16. The drinking device according to claim 12, wherein the closure cap and the conveying means form an insert part for a separate drinking container.

17. The drinking device according to claim 16, wherein the insert part has a connecting means for a releasable attachment to the separate drinking container.

18. The drinking device according to claim 16, wherein the insert part has an elongated conveying means which protrudes centrally into the receiving chamber of the separate drinking container during use.

19. The drinking device according to claim 16, wherein the air inlet opening is connected to the receiving chamber outside of the straw-shaped conveying means via a connecting duct.

20. The drinking device according to claim 1, wherein an outer wall of the drinking container is provided as the outer wall element of the conveying means.

21. The drinking device according to claim 20, wherein the outer wall of the drinking container has a connecting means formed as a thread or a part of a bayonet coupling, configured to releasably attach the drinking container to the connecting means of the closure cap.

22. A drinking device with a drinking container and a closure cap having a drinking opening and intended for closing a drinking container, the drinking device comprising a receiving chamber for liquid and a conveying means, wherein the conveying means has an inner wall element configured to be received in an outer wall element to form a space, wherein the space defines a conveying duct between the wall elements, wherein an annular distribution duct is provided in a region adjoining the closure cap, wherein the conveying means is configured to supply liquid from the receiving chamber into the annular distribution duct, wherein the conveying duct is connected to the receiving chamber via an inlet opening which adjoins a bottom of the drinking container and the conveying duct is connected to the annular distribution duct, and the annular distribution duct is connected to the drinking opening, wherein the space between the outer wall element and the inner wall element allows liquid to uniformly flow through the conveying duct into the annular distribution duct against gravity when suction pressure is applied to the drinking opening, wherein the annular distribution duct is formed by a circumferential protruding flange having a clearance and/or recess and defines a circumferential cavity for distributing the liquid flowing in, wherein the annular distribution duct is delimited by closure-sided end regions of the wall elements of the conveying means, and wherein the outer wall element of the conveying means has a circumferential flange in the closure-sided end region, with a clearance that is open in particular towards the closure cap, wherein the inner wall element rests on at least three points on the outer wall element spaced apart in a circumferential direction, wherein the at least three points are formed by supporting lugs molded on the outer wall element.

23. The drinking device according to claim 22, wherein the wall elements have a conical shape tapering from closure-sided end regions to bottom-sided end regions.

24. The drinking device according to claim 22, wherein the outer wall element is formed by an outer wall of the drinking container, which defines the receiving chamber together with the bottom that is formed integrally with the outer wall.

* * * * *